US010426259B2

(12) United States Patent
Patton et al.

(10) Patent No.: US 10,426,259 B2
(45) Date of Patent: Oct. 1, 2019

(54) ADJUSTABLE HEIGHT TABLE

(71) Applicant: Varidesk, LLC, Coppell, TX (US)

(72) Inventors: David Patton, Flower Mound, TX (US); Lio Yenwei Chang, Lewisville, TX (US)

(73) Assignee: Varidesk, LLC, Coppell, TX (US)

( * ) Notice: Subject to any disclaimer, the term of this patent is extended or adjusted under 35 U.S.C. 154(b) by 0 days.

(21) Appl. No.: 15/672,022

(22) Filed: Aug. 8, 2017

(65) Prior Publication Data

US 2019/0045920 A1 Feb. 14, 2019

(51) Int. Cl.

| | |
|---|---|
| ***A47B 9/14*** | (2006.01) |
| ***A47B 9/16*** | (2006.01) |
| *A47B 87/00* | (2006.01) |

(52) U.S. Cl.

CPC ..... *A47B 9/14* (2013.01); *A47B 9/16* (2013.01); *A47B 87/002* (2013.01)

(58) Field of Classification Search

CPC ..... A47B 3/02; A47B 89/16; A47B 9/16
USPC ..... 108/120, 118, 117, 64
See application file for complete search history.

(56) References Cited

U.S. PATENT DOCUMENTS 188,086 A * 3/1877 White ..... A47B 13/16 108/25
344,874 A * 7/1886 Siebold ..... D06F 81/04 108/117
747,952 A * 12/1903 Dillon ..... D06F 81/04 108/117
1,033,844 A * 7/1912 Tyden ..... A47B 3/02 108/88
1,520,518 A * 12/1924 Thomason ..... A47B 87/002 108/64
2,031,398 A * 2/1936 Wagoner ..... A47B 87/002 108/64

(Continued)

FOREIGN PATENT DOCUMENTS

CN 201001489 Y 1/2008
DE 3439422 A1 4/1986

(Continued)

OTHER PUBLICATIONS

Ares Height Adjustable Folding Table (26"×18"), Mar. 5, 2016, obtained from https://www.youtube.com/watch?V=dYe-4OTbHkM.

(Continued)

*Primary Examiner* — Jose V Chen
(74) *Attorney, Agent, or Firm* — Venable LLP; Michele V. Frank

(57) ABSTRACT

A table having a table top having an upper surface and a lower surface. The table further having a first and second guide track located on the lower surface. A first leg is pivotally connected to a second leg, the first leg comprising a first slide adapted to slidably engage the first guide track, and the second leg comprising a second slide adapted to slidably engage the second guide track. The table further includes a first retainer adapted to engage the first slide and the first guide track to prevent sliding of the first slide with respect to the first guide track, and a second retainer adapted to engage the second slide and the second guide track to prevent sliding of the second slide with respect to the second guide track. The table may be an adjustable height table. Other features of the table are also described.

22 Claims, 14 Drawing Sheets

(56) References Cited

U.S. PATENT DOCUMENTS 2,114,912 A * 4/1938 Cox ..... A47B 3/02 108/120
2,285,597 A * 6/1942 Allen ..... A47B 3/02 108/120
2,288,737 A * 7/1942 Parkhurst ..... A47B 3/02 108/120
2,581,023 A 1/1952 Jerick
2,659,990 A 11/1953 Voigt et al.
2,662,319 A 12/1953 Hortman, Jr.
2,701,425 A 2/1955 Rewald, Jr.
2,746,184 A 5/1956 Davis
2,829,936 A 4/1958 Anderson
3,054,200 A 9/1962 Steinwedel
3,152,833 A * 10/1964 Creveling ..... A47B 3/14 108/117
3,174,443 A 3/1965 Egger
3,329,104 A * 7/1967 Gittings ..... A47B 3/02 108/117
3,760,744 A * 9/1973 Cruckshank ..... A47B 1/08 108/102
4,032,103 A 6/1977 Ehrichs
4,143,602 A 3/1979 Brunn
4,182,511 A * 1/1980 Camp, Jr. ..... A63B 23/0211 108/118
4,404,914 A 9/1983 Taylor
4,665,836 A * 5/1987 Burr ..... A47B 87/002 108/59
4,993,706 A 2/1991 Wilkinson
5,325,794 A * 7/1994 Hontani ..... A47B 3/0911 108/115
5,435,254 A * 7/1995 Amey ..... A47B 13/003 108/64
5,794,545 A * 8/1998 McDaniel ..... A47B 87/002 108/64
5,988,077 A * 11/1999 Balderi ..... A47B 87/002 108/64
6,912,961 B2 7/2005 Winter et al.
6,974,185 B2 * 12/2005 Hsieh ..... A47C 3/36 108/117
7,059,254 B2 6/2006 Strong et al.
7,204,343 B1 4/2007 Seaman
7,246,784 B1 7/2007 Lopez
7,263,932 B2 9/2007 Winter et al.
7,475,640 B2 1/2009 Winter et al.
7,640,869 B2 1/2010 Leng
8,286,926 B1 * 10/2012 Van Dyne ..... F16B 7/105 248/165
9,326,598 B1 5/2016 West et al.
9,504,316 B1 11/2016 Streicher et al.
9,532,645 B1 1/2017 Lin
9,862,088 B2 * 1/2018 Luis y Prado ..... B25H 1/14
2006/0191447 A1 8/2006 Ashby et al.

FOREIGN PATENT DOCUMENTS

DE 4305209 C1 3/1994
FR 2236342 A6 1/1975
FR 2309176 A1 11/1976
WO 03059119 A2 7/2003
WO 04037041 A2 5/2004
WO 2016/200318 A1 12/2016

OTHER PUBLICATIONS

International Search Report and Written Opinion in corresponding International Application No. PCT/US2018/045802 dated Sep. 18, 2018 (10 pages).

* cited by examiner

ADJUSTABLE HEIGHT TABLE

TECHNICAL FIELD

The present application relates to an adjustable height table. More specifically, the present application relates to an adjustable height table having multi-position leg mounting brackets that provide for table height adjustments.

BACKGROUND

Adjustable height tables typically include two pairs of legs, with each pair connected across the top with a cross bar. The pairs of legs are pivotally connected in an "X"-shaped configuration. One or both of the cross bars is received into leg receiving slot(s) located on a lower surface of the table top. The leg receiving slot(s) may be integral to the table, such as through molding. Alternatively, the leg receiving slot(s) may be a separate piece, such as a bracket, that is secured to the table top. In either case, generally, a plurality of slots are located parallel to one another. To select a table height, the user locates each of the cross bars on the legs within a receiving slot corresponding to the desired table height. Examples of such tables include T.V. and portable tray tables, as well as ironing boards.

SUMMARY

According to an embodiment, a table may include a table top including an upper surface and a lower surface, a first guide track and a second guide track located on the lower surface of the table top, a first leg pivotally connected to a second leg, the first leg comprising a first slide adapted to slidably engage the first guide track, and the second leg comprising a second slide adapted to slidably engage the second guide track, and a first retainer adapted to engage the first slide and the first guide track to prevent sliding of the first slide with respect to the first guide track, and a second retainer adapted to engage the second slide and the second guide track to prevent sliding of the second slide with respect to the second guide track.

According to an embodiment, an adjustable height table, may include a table top including an upper surface and a lower surface, a first guide track located on the lower surface of the table top, the first guide track having a first positioning hole and a second positioning hole, a second guide track located on the lower surface of the table top, the second guide track having a third positioning hole and a fourth positioning hole, a first leg pivotally connected to a second leg, the first leg comprising a first slide adapted to slidably engage the first guide track, and the second leg comprising a second slide adapted to slidably engage the second guide track, the first slide having a first slide locating hole and the second slide having a second slide locating hole, a first retainer adapted to engage the first slide and the first guide track to prevent sliding of the first slide with respect to the first guide track, and a second retainer adapted to engage the second slide and the second guide track to prevent sliding of the second slide with respect to the second guide track, and wherein, when engaged, the first slide locating hole is aligned with one of the first positioning hole and the second positioning hole and the second slide locating hole is aligned with one of the third positioning hole and the fourth positioning hole.

According to an embodiment, a multi-position mounting bracket may include a guide track having a projecting support and a stop, a slide having a flange, and a retainer, the retainer adapted to engage the slide and the guide track to prevent sliding of the slide with respect to the guide track.

BRIEF DESCRIPTION OF THE DRAWINGS

The foregoing aspects and other features and advantages of the invention will be apparent from the following drawings, wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention. All references cited herein are incorporated by reference as if each had been individually incorporated.

Figure 1:
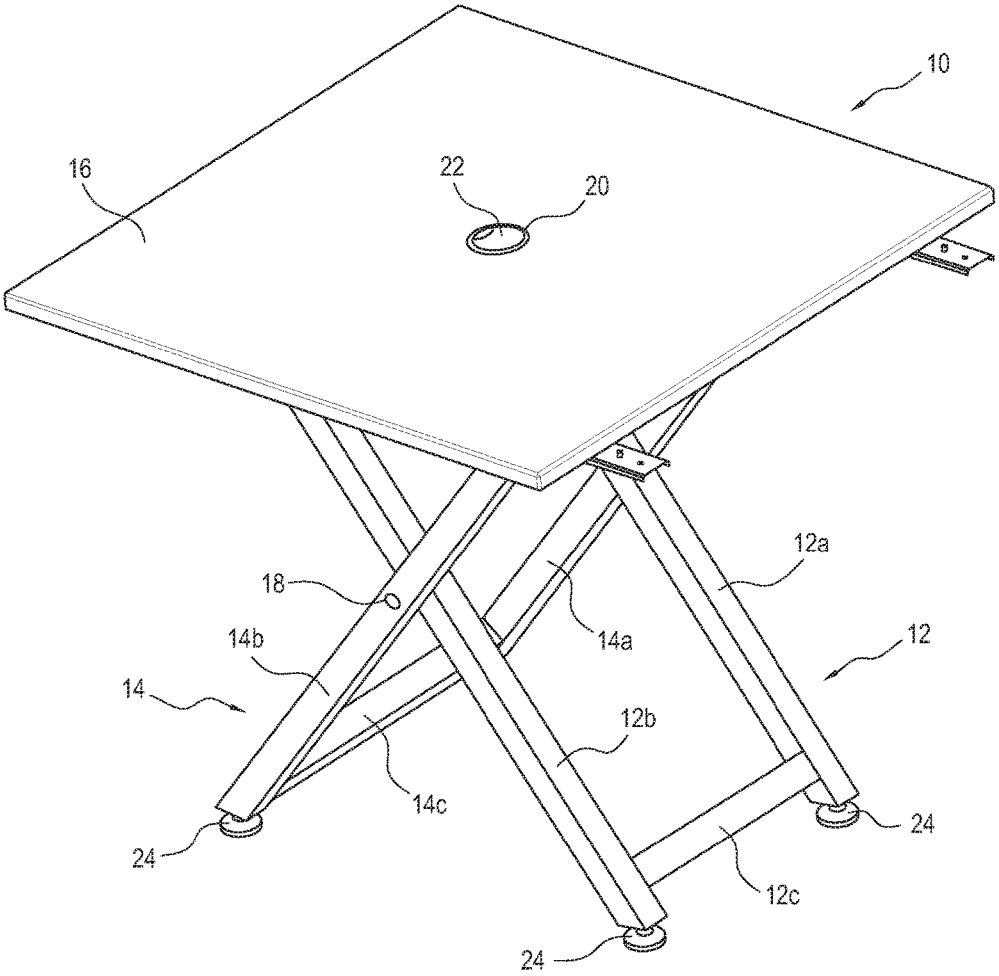
FIG. 1 is a perspective view of an adjustable height table from above, according to an embodiment.

Referring to FIG. 1, an embodiment of a table 10 according to the present invention is shown. The table 10 may include a first pair of legs 12 and a second pair of legs 14. The first pair of legs 12 and second pair of legs 14 may be connected to a table top 16. The first pair of legs 12 and second pair of legs 14 may be pivotally connected such that they may be moved through a plurality of positions with respect to one another, for example, and without limitation, a first position (FIG. 6A), second position (FIG. 6B), and a third position (FIG. 6C). As will be described in more detail below, the legs can be connected to the table top 16 in two or more different positions to provide for different heights of the table top 16.

Still referring to FIG. 1, the pivotal connection may be a fastener 18. The fastener 18 may be a bolt extending through a hole in the first pair of legs 12 and the second pair of legs 14 and secured with a nut on a side opposing the head of the bolt. Alternatively, the fastener 18 may be any fastener, shaft, rivet, pin, or other device which allows for relative movement between the first pair of legs 12 and the second pair of legs 14. The first pair of legs 12 and second pair of legs 14 may be connected such that in side view, the legs have the appearance of an "X" shape (FIG. 4A), however other configurations are possible. The first pair of legs 12 and the second pair of legs 14 may comprise any material capable of supporting table top 16, such as wood, plastic, metal, composite, etc. The table top 16 may comprise, for example, wood, plastic, metal, composite, laminate, stone, marble, concrete, glass, or other known materials.

Figure 2:
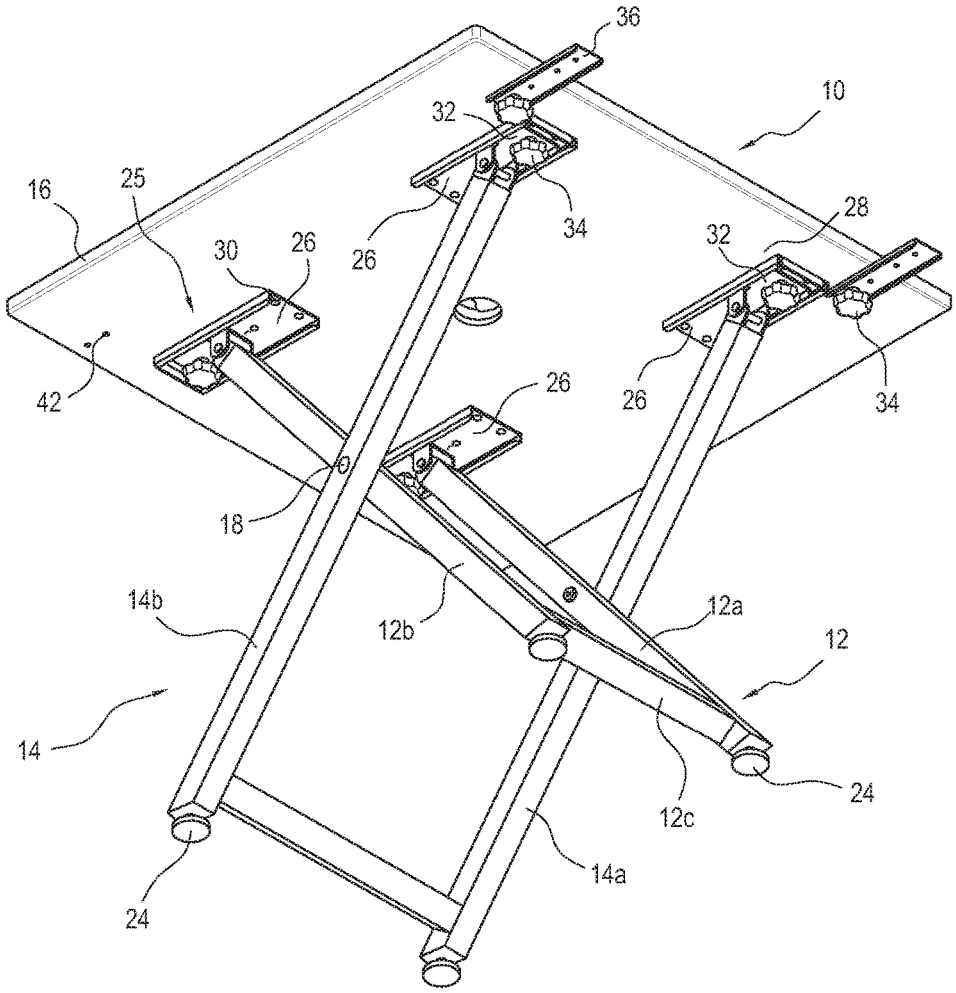
FIG. 2 is a perspective view of the adjustable height table of FIG. 1, from below.

With continued reference to FIG. 1, the table top 16 may define an aperture 20, and may include a cover 22 sized to fit within and at least partially close the aperture 20. The aperture 20 may provide for passage of cables, such as power cords or signal cables, through the table top 16. The cover 22 may cover some or all of the aperture giving the appearance and function of a continuous table top. According to an embodiment, the cover 22 may include a cutaway portion to allow for the passage of cables through the aperture 20 when the cover 22 is in place. Alternatively, the cover 22 may be removed from the aperture 20 when cables are passing through the aperture 20. Referring to FIG. 2, the aperture 20 may also be used to hold hand knobs 34 (FIG. 2) or like components during storage, packaging, or shipment of the table. With the cover 22 in place, the hand knobs 34 or like components may be placed in the aperture 20 from the lower surface 28 of the table top 16.

Referring again to FIG. 1, the first pair of legs 12 may include a first leg 12*a* and a second leg 12*b*. The first leg 12*a* and second leg 12*b* may be attached with a first lateral connecting member 12*c*. The first leg 12*a*, second leg 12*b*, and first lateral connecting member 12*c* may be unitary in structure or may be connected together in any known manner, such as welding, adhesion, molding, fastening, etc. The second pair of legs 14 may include a third leg 14*a* and a fourth leg 14*b*. The third leg 14*a* and fourth leg 14*b* may be attached with a second lateral connecting member 14*c*. The third leg 14*a*, fourth leg 14*b*, and second lateral connecting member 14*c* may be unitary in structure or may be attached in any known manner, such as welding, adhesion, molding, fastening, etc. Each of legs 12*a*, 12*b*, 14*a*, 14*b* may include a foot 24. The foot 24 may be a leveler which allows a user to individually adjust the height of each leg 12*a*, 12*b*, 14*a*, 14*b* to provide a level table top 16. For example, according to an embodiment, each foot 24 can include a threaded connection to the underside of the respective leg, allowing the user to thread the foot into or out of the leg to make fine adjustments to the leg's height. Although two pairs of legs 12, 14 are described, more pairs of legs may be provided, for example, three, four, or more pairs. Additionally, it will be appreciated that embodiments of the present disclosure are not limited to pairs of legs 12, 14. For example, embodiments may include two legs that are each wide enough to provide sufficient stability. Alternatively, embodiments may include one wide leg surrounded by a pair of narrow legs on each side.

Each leg 12*a*, 12*b*, 14*a*, 14*b* may define a midpoint at which the pivotal connection is provided. The midpoint of the first leg 12*a* may be pivotally connected to the midpoint of the third leg 14*a* with fastener 18. The midpoint of the second leg 12*b* may be pivotally connected to the midpoint of the fourth leg 14*b* with another fastener 18. Although the pivotal connection is depicted at the midpoint, it is to be understood that the pivotal connection may be provided at other locations proximate to the midpoints.

Although the table 10 is depicted and described as a square table, it will be appreciated based on this disclosure that the table may take any shape, for example, the table may be rectangular, elongated, oval, elliptical, circular, polygonal, or any other shape. Additionally, the table may be, for example, a desk, conference table, standing table, coffee table, console table, outdoor table, or other type of table.

Referring now to FIG. 2, an underside of table 10 according to an embodiment of the invention is shown. The table 10 can include multi-position leg mounting brackets 25 that connect the legs 12, 14 to the lower surface of the table top 16. According to an embodiment, each multi-position leg mounting bracket 25 can include a guide track 26, a slide 32, and a retainer, such as a knob 34, as will be described in more detail below. Although one multi-position leg mounting bracket 25 is described with each leg 12*a*, 12*b*, 14*a*, 14*b*, it will be understood that more than one multi-position mounting bracket may be used for each leg 12*a*, 12*b*, 14*a*, 14*b* or for each pair of legs 12, 14.

Still referring to FIG. 2, each multi-position leg mounting bracket 25 can include a guide track 26 provided on the lower surface 28 of table top 16. The guide tracks 26 may be integral with the lower surface 28 of the table top 16, such as through molding, routing, casting, or machining. Alternatively, the guide tracks 26 may be attached to the lower surface 28 of the table top 16 in any known manner, such as welding, adhesion, molding, fastening, etc. The guide tracks 26 may have projecting supports 30 which may receive the slide 32. The projecting supports 30 may be channels having side and top surfaces that engage respective flanges 50 (FIG. 8) on slide 32, although other supportive shapes are contemplated. A lower surface of the flanges 50 (FIG. 8) may engage top protruding surfaces of corresponding projecting supports 30 to fix the slide 32 in the guide track in the direction perpendicular to the plane of the guide track 26. The slide 32 may be secured in position on the guide track 26 with a retainer, such as hand knob 34, in a manner to be described herein.

With continued reference to FIG. 2, one or more brackets 36 may be attached to the lower surface 28 of table top 16. Brackets 36 may attach to holes 42 (FIG. 3) in the lower surface 28 of table top 16 with hand knobs 34, for example, by using mating threads or a quarter-turn cam arrangement. The brackets 36 may connect the table 10 to other equipment or other tables to construct a larger table of any size or configuration. A plurality of holes may be provided on the brackets 36. In operation, a table 10 may be placed next to another piece of equipment, such as a second table 10. A bracket 36 may be placed on the lower surface 28 of the first table 10 and aligned with holes in the lower surface 28 of the first table 10. A hand knob 34 may be installed in holes of the bracket 36 to secure the bracket 36 to the first table 10. The opposing side of the bracket 36 may be aligned with holes in the lower surface 28 of the second table 10. A second hand knob 34 may be installed in a second hole on bracket 36 to secure the bracket 36 to the second table 10. The bracket 36 may thus secure the first table 10 to the second table 10. Additional brackets 36, hand knobs 34, and holes may be provided to further secure the first table 10 to the second table 10. Although brackets 36 are depicted attached to one side of the table 10, it is understood that the brackets 36 may be connected to any number or all of the sides of the table 10. For example, three tables 10 may be attached in a rectangular shape such that they are one table wide by three tables long. Alternatively, for example, four tables 10 may be attached in a square shape such that they are two tables wide by two tables wide. Thus, a person of skill in the art will appreciate that any number of sizes, shapes, and configurations may be achieved based on the size, shape, and configuration of the individual tables 10 and the size, shape, configuration, and number of the tables 10 which are attached to one another. Additionally, it will be appreciated that other known manners of connecting multiple tables together may be provided in place of hand knobs 34 and brackets 36, such as, for example, flanges, latches, or conventional fasteners.

Figure 3:
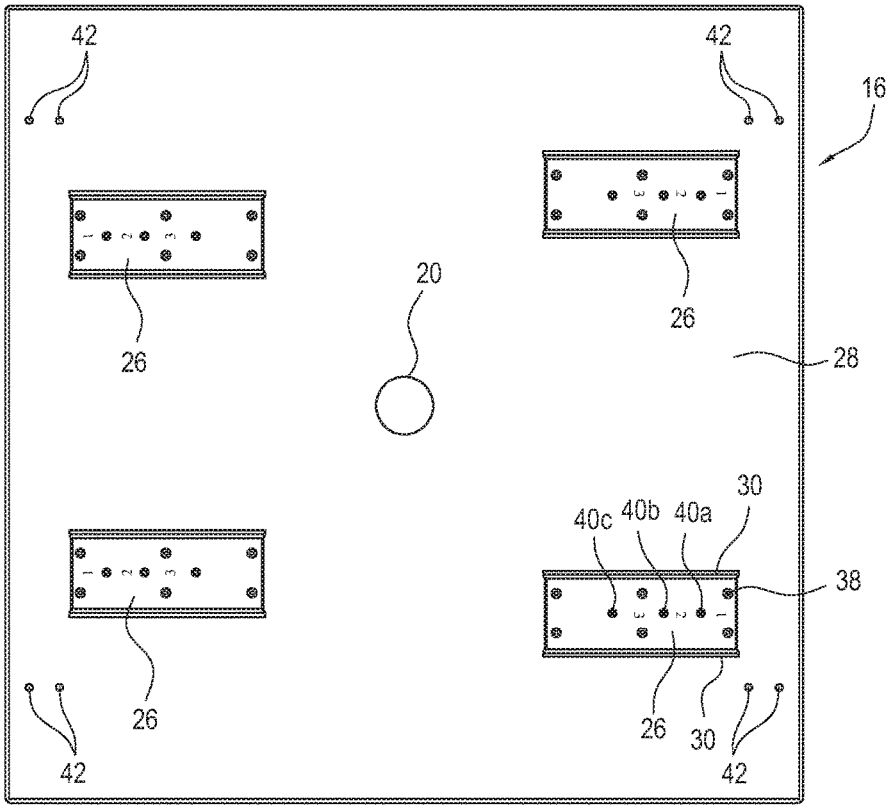
FIG. 3 is a bottom view of a table top of the adjustable height table according to FIG. 1 shown with the table legs detached.

Referring to FIG. 3, a bottom view of the table top 16 in a detached position is shown. The lower surface 28 of table top 16 may include guide tracks 26 as previously described. The guide tracks 26 may be attached to the table top 16 by fasteners 38. The fasteners 38 may extend into holes (not depicted) in the lower surface 28 of the table top 16 for securing the guide tracks 26 thereto. Alternatively, the guide tracks 26 may be secured to the lower surface 28 of the table top 16 in other manners, such as welding, adhesion, molding, etc. Each guide track 26 may be provided with a plurality of positioning holes 40. Positioning holes 40 may accommodate the hand knobs 34 for securing the legs 12, 14 to the lower surface 28 of the table top 16. As depicted in FIG. 3, three positioning holes 40*a*, 40*b*, 40*c* may be provided in each guide track 26. Each positioning hole 40 may correspond to a predetermined table height. As will be described herein, this may allow the height of the table 10 to be selected and altered as desired. Although three positioning holes 40*a*, 40*b*, 40*c* are depicted, it is understood that more or less positioning holes may be provided. The guide tracks 26 and brackets 36 may be constructed of one or more of metal, plastic, composite, or other known materials.

With continued reference to FIG. 3, holes 42 may be provided in the lower surface 28 of the table top 16 for attaching brackets 36 thereto. Multiple holes 42 may be provided to allow a user to select the desired distance at which the bracket 36 is attached. In this manner, brackets 36 of different sizes may be accommodated and the distance between adjacent tables may be selected based on user preference.

Figure 4A:
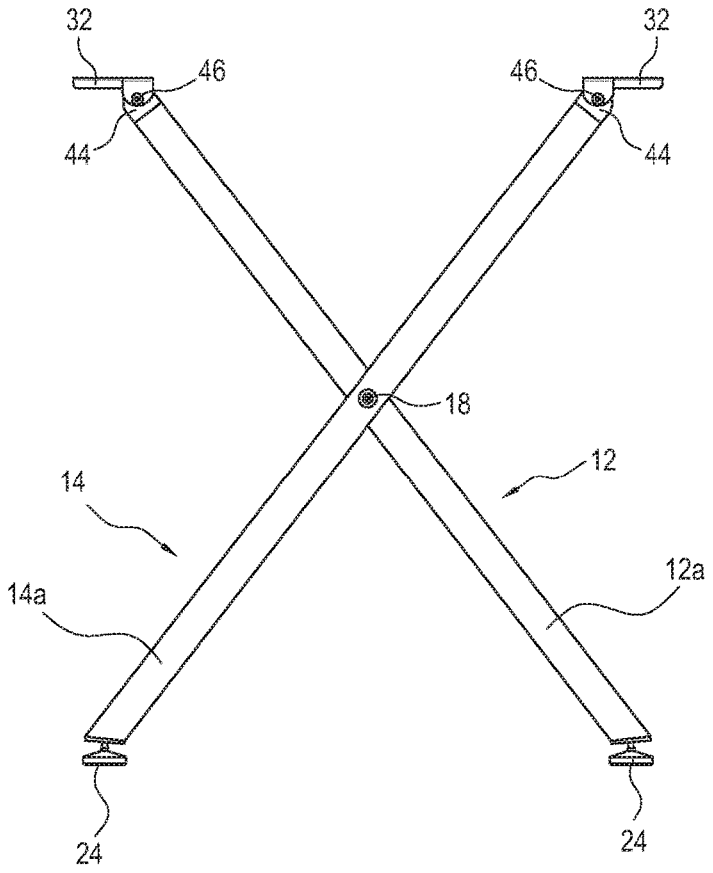
FIG. 4A is a side view of table legs of the adjustable height table according to FIG. 1 shown detached from the table top.
Figure 4B:
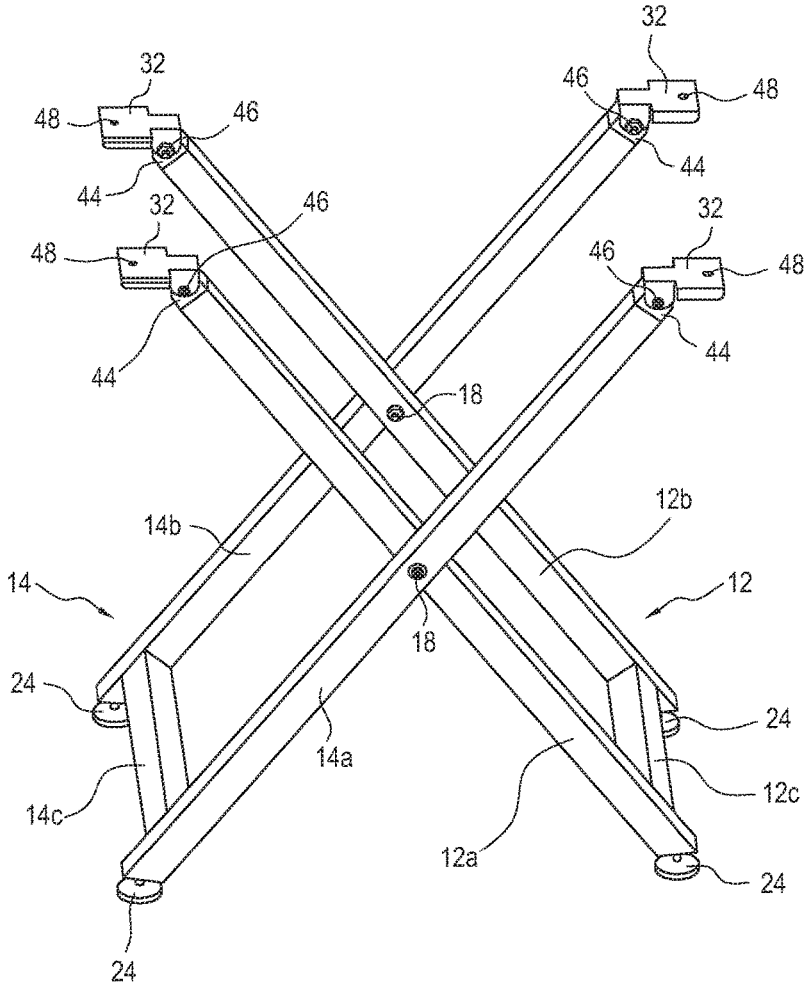
FIG. 4B is a side, perspective view of table legs of the adjustable height table according to FIG. 1 shown detached from the table top.

Referring now to FIGS. 4A and 4B, the first pair of legs 12 and second pair of legs 14 are shown detached from the table top 16. Each of the first leg 12*a*, second leg 12*b*, third leg 14*a*, and fourth leg 14*b* may be provided with a rounded end 44 which is attached to slide 32 with a pivoting connection 46. The pivoting connection 46 may allow for a user to pivot the first pair of legs 12 relative to the second pair of legs 14. The pivoting connection 46 may allow for the legs 12, 14 to connect to the table top 16 in various positions, including the positions depicted in FIGS. 6A-6C. The pivoting connection 46 may comprise a fastener, a bolt and nut, a shaft, a pin, a rivet, or other member which allows for relative movement between the first pair of legs 12 and the second pair of legs 14 and their respective slide 32.

With reference to FIG. 4B, the slide 32 may include one or more locating holes 48. The locating hole 48 in each slide 32 may align with one of the positioning holes 40*a*, 40*b*, 40*c* (FIG. 3) on the lower surface 28 of the table top 16. As will be described with reference to FIGS. 6A-6C, each slide 32 may be mated with a corresponding guide track 26. The locating hole 48 on the slide 32 may be aligned with one of positioning holes 40*a*, 40*b*, 40*c* where each positioning hole 40*a*, 40*b*, 40*c* corresponds to a desired height of the table. Once aligned, a retainer, such as hand knob 34, may be inserted into the locating hole 48 and selected positioning hole 40*a*, 40*b*, 40*c*. The hand knob 34 may be secured into place, for example, by threaded engagement with the guide track 26 and/or table top 16. The slides 32 of the remaining three legs may be aligned with the same hole as the first slide 32 and secured into place with a retainer, such as hand knob 34. That is, where a first slide 32 of first leg 12*a* is aligned with positioning hole 40*a* and secured therein with hand knob 34, the remaining slides 32 of legs 12*b*, 14*a*, and 14*b* may be aligned with position hole 40*a* on their respective guide tracks 26 and secured therein with a hand knob 34. It will be appreciated that a similar alignment may be performed for locating positioning holes 40*b* and 40*c*. Additionally, more than one positioning hole in each guide track 26 may be provided for each height position.

Figure 5:
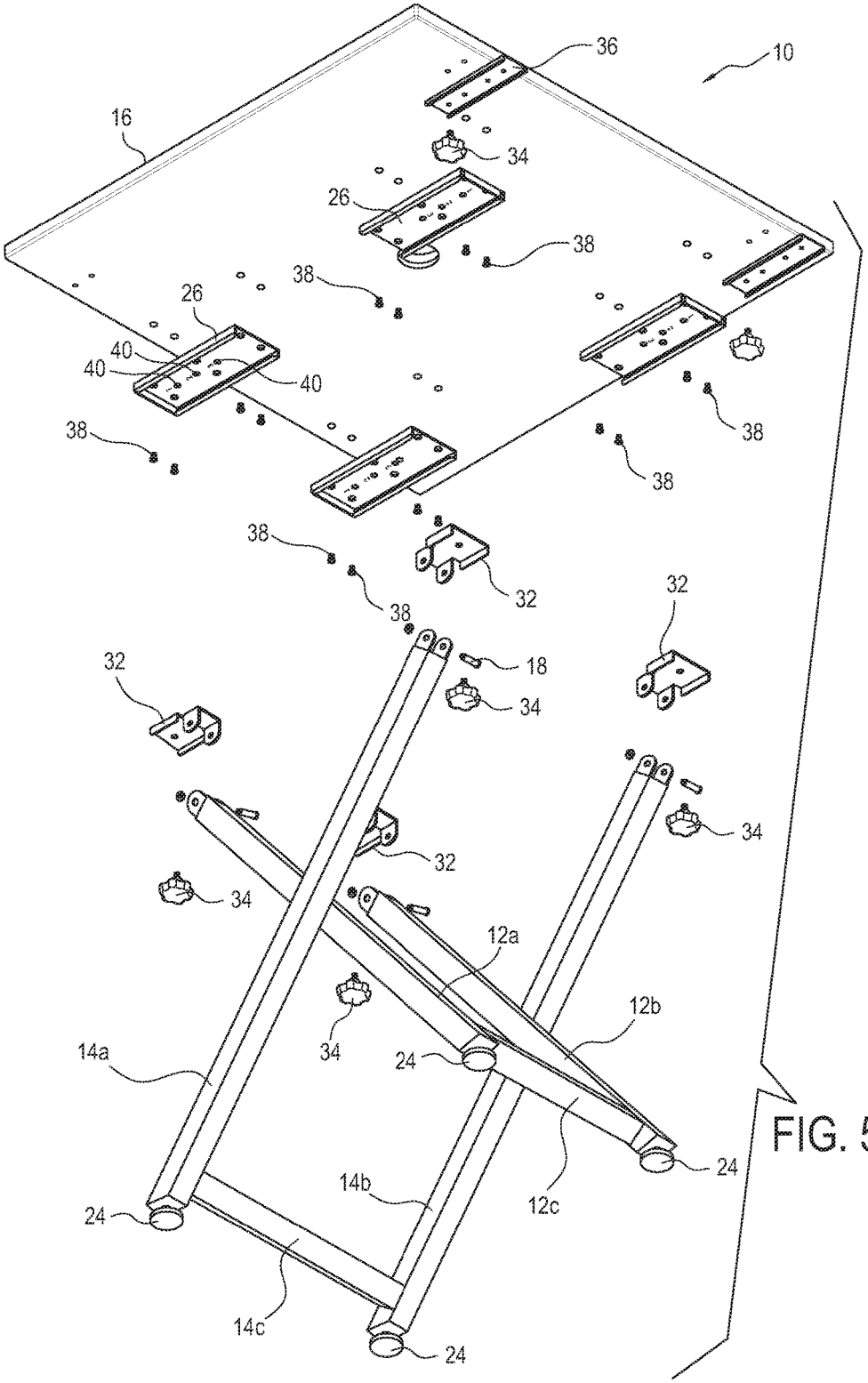
FIG. 5 is an exploded view of the adjustable height table according to FIG. 1.

FIG. 5 shows an exploded view of the table 10. From this view, it may be appreciated that each leg 12*a*, 12*b*, 14*a*, and 14*b* has a corresponding slide 32. The slides 32 of each leg 12*a*, 12*b*, 14*a*, and 14*b* may be installed in the guide tracks 26 such that a flange 50 (FIG. 8) of the slide 32 engages a projecting support 30 (FIG. 8) of the guide track 26 in a slideable manner, as will be described in more detail below. The slide 32 may be substantially rectangular with a connecting member 54 (FIG. 8) protruding therefrom. The slide 32 may have a substantially flat surface configured to mate with the substantially flat lower surface 28 of the table top 16. Fasteners 38 and 18 may be generally cylindrical shaped and may be provided with or without threaded surfaces for engaging with respective members of the table top 16 and legs 12, 14. The cylindrical shape may allow for engagement with respective apertures in the table top 16 or legs 12, 14 for attachment and/or pivoting.

Figure 6A:
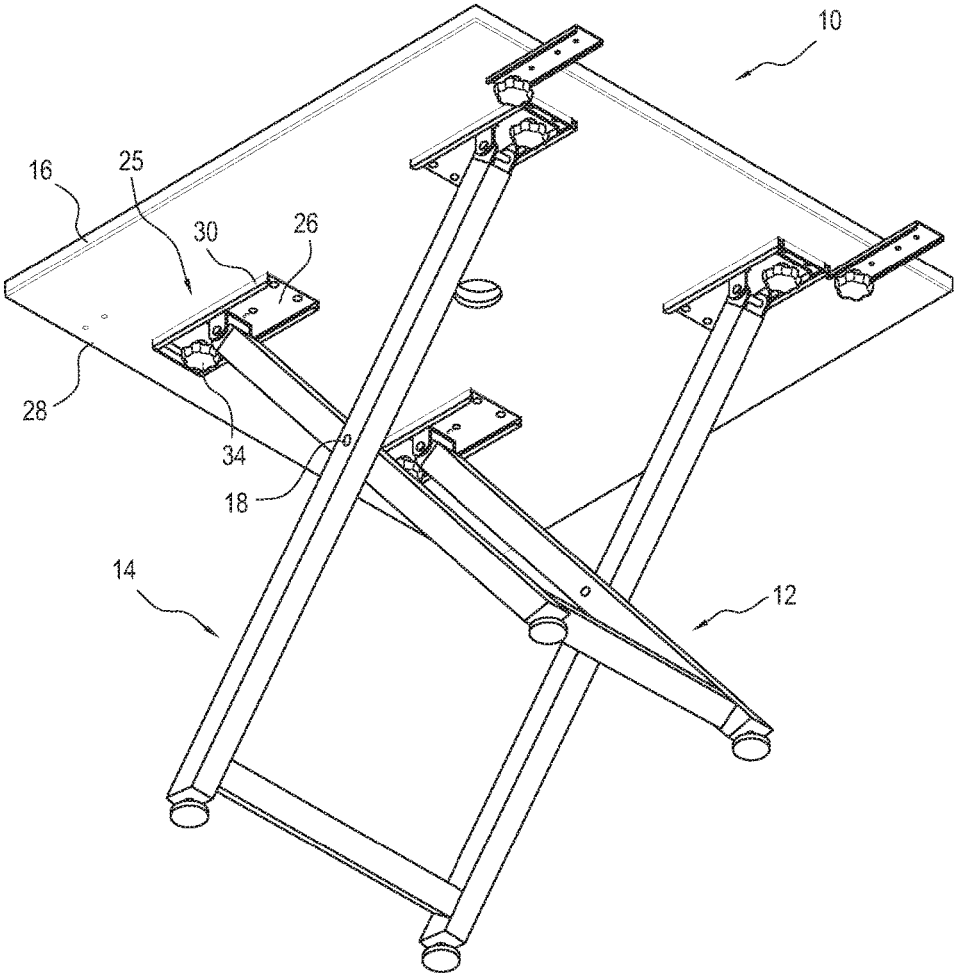
FIG. 6A is a side, perspective view of the adjustable height table according to FIG. 1 in a first position.
Figure 6B:
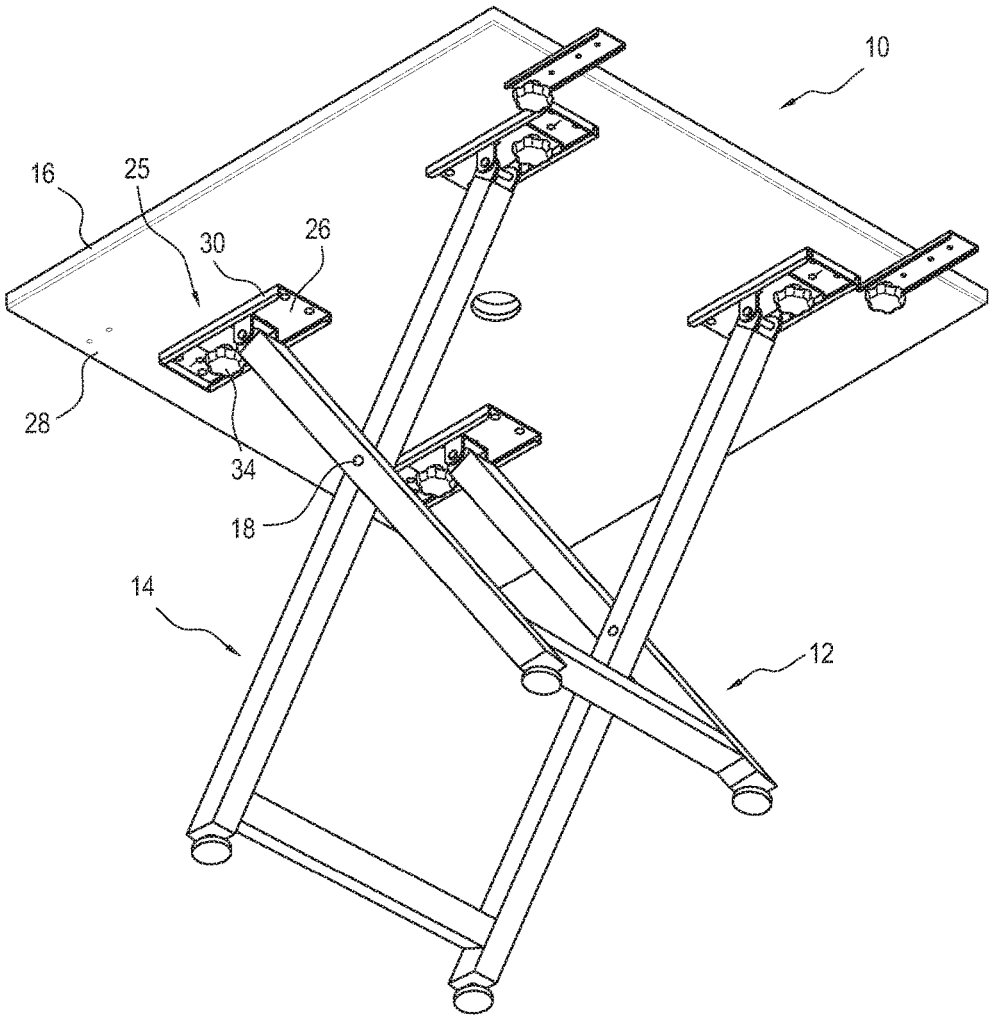
FIG. 6B is a side, perspective view of the adjustable height table according to FIG. 1 in a second position.
Figure 6C:
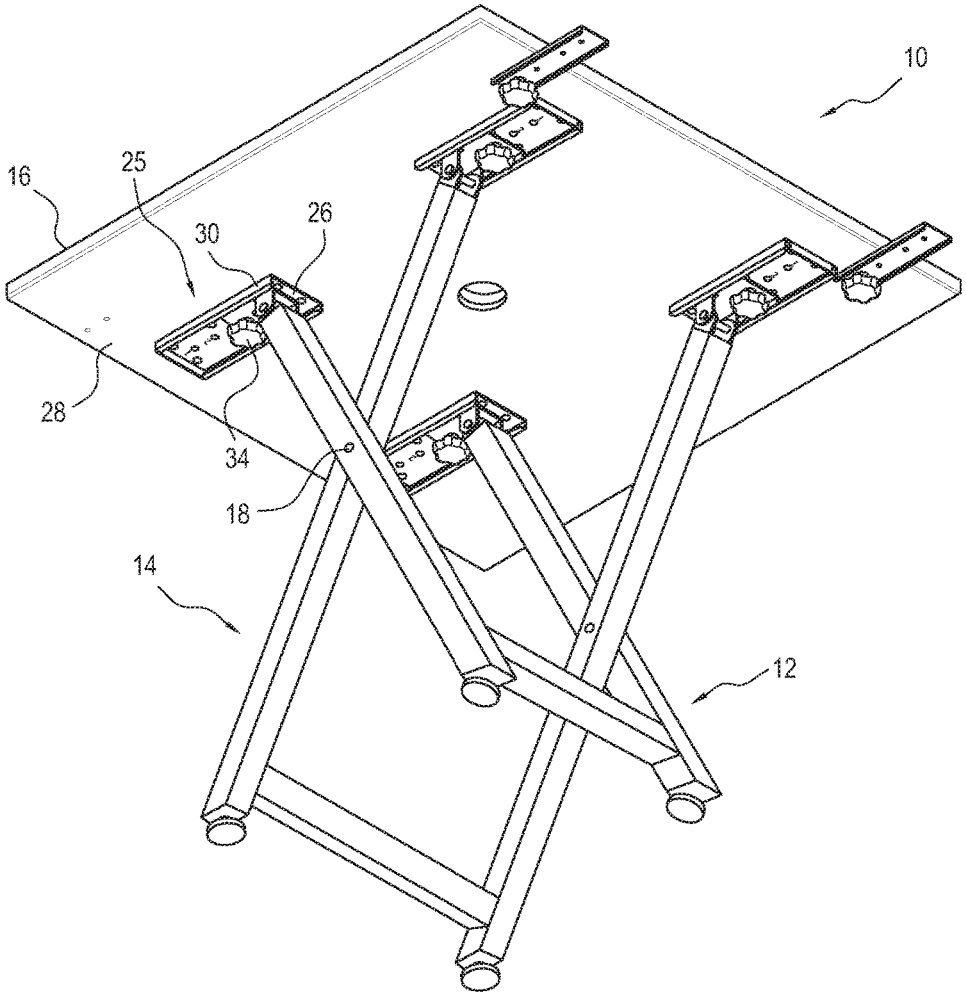
FIG. 6C is a side, perspective view of the adjustable height table according to FIG. 1 in a third position.

Referring to FIGS. 6A-6C, the table 10 is shown with the legs 12, 12 in three different positions corresponding to three different heights of the table top 16. In FIG. 6A, the table 10 may be in a low height position. The locating holes 48 (FIG. 8) on the slides 32 of legs 12*a*, 12*b*, 14*a*, 14*b* may be aligned with positioning holes 40*a* (FIG. 3) on the respective guide tracks 26. The retainers, such as hand knobs 34, may secure the slides 32, and thus the pairs of legs 12 and 14 to the table top 16 in this position. The table 10 may thus be in a secured position corresponding to the predetermined height of positioning hole 40*a*.

In FIG. 6B, the table 10 may be in a medium height position. The locating holes 48 (FIG. 8) on the slides 32 of the legs 12*a*, 12*b*, 14*a*, 14*b* may be aligned with positioning holes 40*b* (FIG. 3) on the respective guide tracks 26. The retainers, such as hand knobs 34, may secure the slides 32, and thus the pairs of legs 12 and 14 to the table top 16 in this position. The table 10 may thus be in a secured position corresponding to the predetermined height of positioning hole 40*b*.

In FIG. 6C, the table 10 may be in a high height position. The locating holes 48 (FIG. 8) on the slides 32 of the legs 12*a*, 12*b*, 14*a*, 14*b* may be aligned with positioning holes 40*c* (FIG. 3) on the respective guide tracks 26. The retainers, such as hand knobs 34, may secure the slides 32, and thus the pairs of legs 12 and 14 to the table top 16 in this position. The table 10 may thus be in a secured position corresponding to the predetermined height of positioning hole 40*c*.

With continued reference to FIGS. 6A-6C, it will be appreciated that more or fewer positioning holes 40 may be provided. The number of positioning holes 40 may be selected to achieve a predetermined number of adjustable height positions of the table top 16 above the floor, and predetermined heights of the adjustable height positions. The location of the positioning holes 40 and/or the length of the pairs of legs 12, 14 may also be chosen to provide predetermined heights when the table 10 is in the installed positions corresponding to any of FIGS. 6A-6C. Any desired range of heights may be provided with the adjustable height table. Exemplary height ranges may be 26 inches to 48 inches, 26 inches to 30 inches, 30 inches to 40 inches, or 40 inches to 48 inches.

Figure 7A:
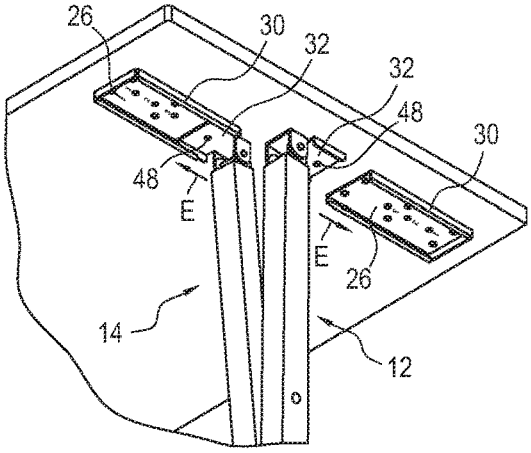
FIG. 7A is a detail view of the bottom surface of the adjustable height table according to FIG. 1 with the legs in a first position.
Figure 7B:
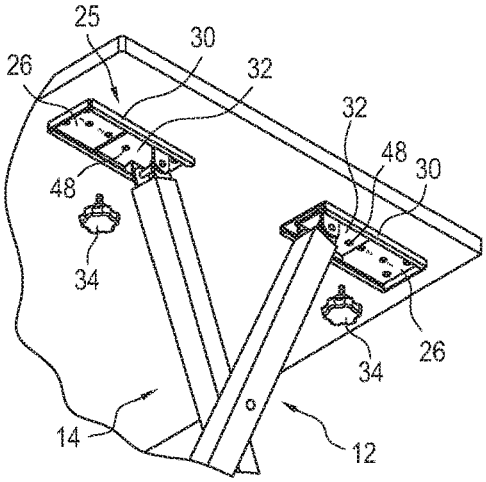
FIG. 7B is a detail view of the bottom surface of the adjustable height table according to FIG. 1 with the legs in a second position.
Figure 7C:
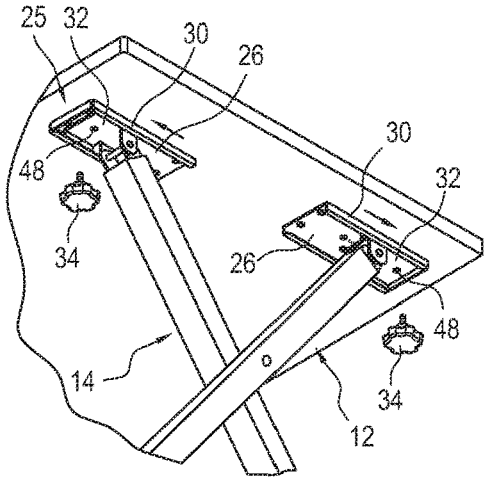
FIG. 7C is a detail view of the bottom surface of the adjustable height table according to FIG. 1 with the legs in a third position.

FIGS. 7A-7C show the installation of the pairs of legs 12 and 14 into engagement with the table top 16. It will be appreciated that although one side of the table 10 is shown in the installation process, the opposing side of the table may be installed with the same or similar procedure. In FIG. 7A, a slide 32 on each pair of legs 12 and 14, for example, a slide on each of first leg 12*a* and third leg 14*a*, is inserted laterally into an open end of the guide track 26. As the slides 32 are provided into the channels created by projecting supports 30, the flange 50 (FIG. 8) of the slide 32 engages the projecting support 30 such that the slide 32 is retained in the guide track 26 in a vertical direction due to the mating geometries of the flange 50 and projecting support 30. The slides 32 are moved in the direction of the arrows "E" further into the guide track 26, the pairs of legs 12 and 14 begin to open from the substantially vertical position of FIG. 7A to the positions of FIGS. 7B and 7C where the pairs of legs 12, 14 are more angled with respect to one another.

FIG. 7B shows the slides 32 of the first leg 12*a* and third leg 14*a* aligned with a first set of holes (for example, one of positioning holes 40*a*, 40*b*, 40*c* in FIG. 3). Once aligned, a retainer, such as hand knob 34, may be secured in the slides of each of first leg 12*a* and third leg 14*a*. Thus, the position of the slide 32 in guide track 26 of FIG. 7B may correspond to a predetermined height of the table top 16 above the ground, such as, for example, the positions of FIGS. 6A-6C. Similarly, FIG. 7C depicts the slides 32 extended further into the guide tracks 26 than the position of either of FIGS. 7A and 7B. In the position of FIG. 7C, the table may be at a lower height than either of positions of FIG. 7A or 7B due to the pairs of legs 12 and 14 being extending further from the vertical position of FIG. 7A. It may be appreciated that as the slides 32 of first leg 12*a* and third leg 14*a* are installed in guide tracks 26, the slides 32 of second leg 12*b* and fourth leg 14*b* may be installed in their respective guide tracks 26 simultaneously or substantially simultaneously. Although hand knobs 34 are described for retaining slides 32 in guide tracks 26, it is understood that other fastening members may be used, such as, for example, pins, fasteners, screws, bolts, or other fastening members.

Figure 8:
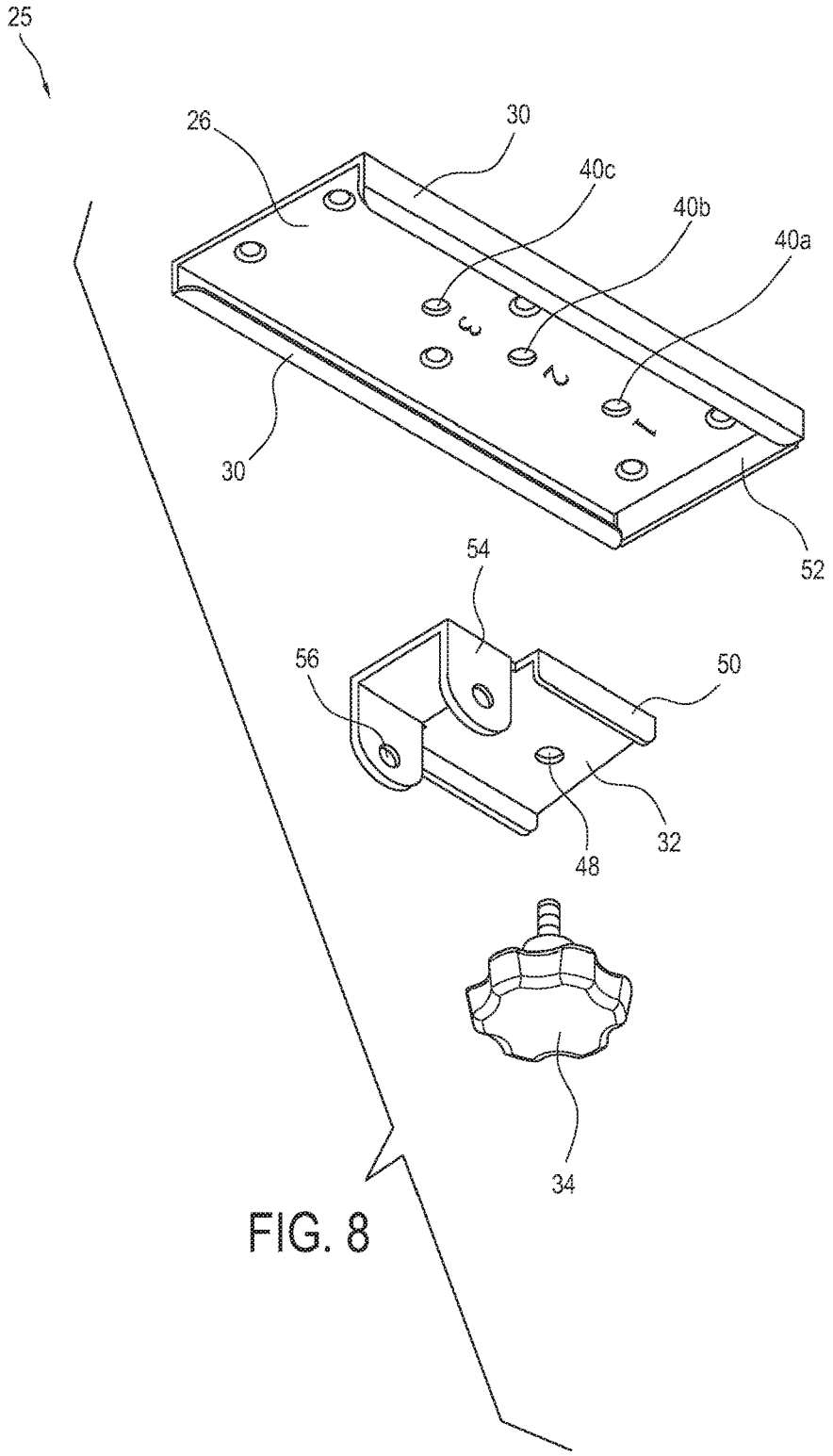
FIG. 8 is an exploded view of an embodiment of a multi-position leg mounting bracket of the adjustable height table according to FIG. 1.

FIG. 8 shows an exploded view of an embodiment of a multi-position leg mounting bracket 25 according to the present invention. As mentioned previously, the bracket 25 may include a guide track 26, slide 32, and a retainer to secure the slide 32 in position on the guide track 26, such as a hand knob 34. Guide track 26 may include projecting supports 30 and stop 52. The projecting supports 30 may be channels having side and top surfaces that engage the respective flanges 50 on slide 32, although other supportive shapes are contemplated. During installation, the slide 32 may be guided laterally into an open end of the guide track 26. The flanges 50 of the slide 32 may engage with the projecting supports 30 on the guide track 26. In the installed position, a lower surface of the flanges 50 may engage the top protruding surfaces of corresponding projecting supports 30 to fix the slide 32 in the guide track in the direction perpendicular to the plane of the guide track 26. Thus, prior to installation of the retainer (hand knob 34), the mating engagement of flange 50 and projecting support 30 may retain the slide in a vertical direction with respect to the legs, such that the table top 16 is supported by the pairs of legs 12, 14. The slide 32 can then be slid until the locating hole 48 aligns with the desired positioning hole 40*a*, 40*b*, 40*c* (e.g., corresponding to the desired table top height). The slide 32 can then be retained in position on the guide track 26, for example, by securing the hand knob 34 in the locating hole 48 and corresponding positioning hole 40*a*, 40*b*, 40*c*. The hand knob 34 may be secured into the locating hole 48 by corresponding threaded surfaces on a stem of the hand knob 34 and the interior surface of the locating hole 48. Alternatively, a quarter-turn cam arrangement or spring-loaded pin may be provided to retain the slide 32 in the guide track 26. The hand knob 34 may be threadingly, or otherwise, engaged with the guide track 26 or the lower surface 28 of the table top 16.

Referring again to FIG. 8, the slide 32 may include a connecting member 54 with holes 56. The connecting member 54 may be generally u-shaped (e.g., with square corners) or c-shaped, although other shapes are possible. The connecting member 54 may attach the slide 32 to one of the legs in the pairs of legs 12, 14. The pivoting connection 46 (FIG. 4B) may comprise a pin, rivet, fastener, or other member that extends through holes 56 in connecting member 54, as well as through a hole in the rounded end 44 of each leg. The pin, rivet, fastener, or other member may be retained on the connecting member 54 and/or leg. The pivoting connection 46 allows relative movement between the slide 32 and the respective leg of the pair of legs 12, 14.

With continued reference to FIG. 8, a stop 52 may be provided on the guide track 26. The stop 52 may prevent the slide 32 from being extended too far into the guide track 26. The stop 52 may prevent the slide 32 from exiting the guide track 26. When a forward most end of the slide 32 engages a surface of the stop 52, the slide 32, and thus the leg 12*a*, 12*b*, 14*a*, 14*b* to which it is attached, is prevented from extending any further.

It may be appreciated from FIG. 8, that when slide 32 is installed in the guide track 26, engagement between the flanges 50 and respective projecting supports 30 prevents collapse of the table 10. That is, even if a hand knob 34 has not yet been installed, or in the event a hand knob 34 is omitted, falls out, or is taken out by a user, the engagement of the flanges 50 on the surface of the respective projecting supports 30 will prevent the slide 32, and thus the leg 12*a*, 12*b*, 14*a*, 14*b* to which it is attached, from falling to the ground. When the table 10 is assembled and resting on the ground, force pushing slide 32 against the stop 52 prevents the table from collapsing, even without hand knob 34 installed. The guide tracks 26, slides 32, and/or hand knobs 34 may be constructed of one or more of metal, plastic, composite, or other known materials. The guide tracks 26, slides 32, and/or hand knobs 34 may be constructed of the same or different materials.

To collapse the table 10, after use or for storage, a user may first remove the retainers (e.g., hand knobs 34) from the positioning holes 40 and locating holes 48. The slides 32 may then be guided out of guide tracks 26. As previously mentioned, the hand knobs 34 may be stored in aperture 20. The pairs of legs 12 and 14 may be collapsed from the "X" shaped position depicted to a substantially flat position where the first pair of legs 12 and second pair of legs 14 are substantially parallel.

Figure 9:
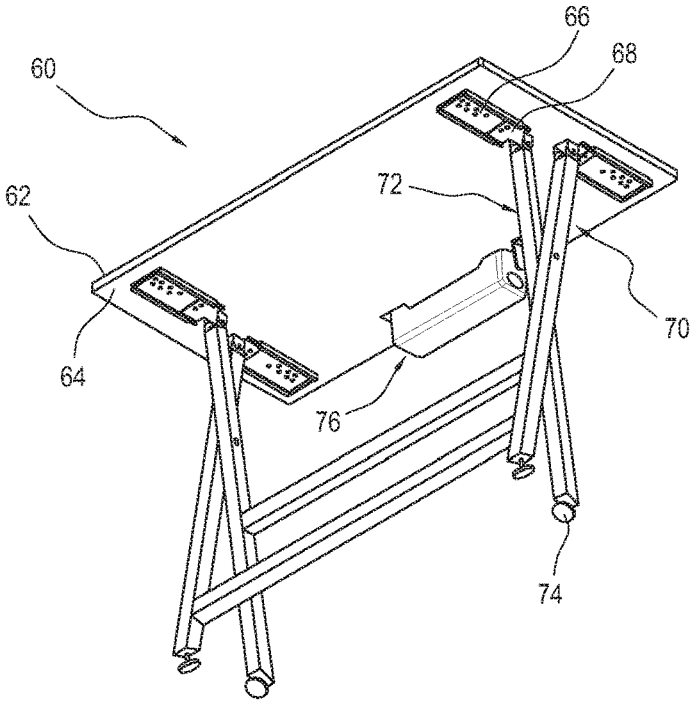
FIG. 9 is a perspective view of an adjustable height table from below, according to an embodiment in a first position.
Figure 10:
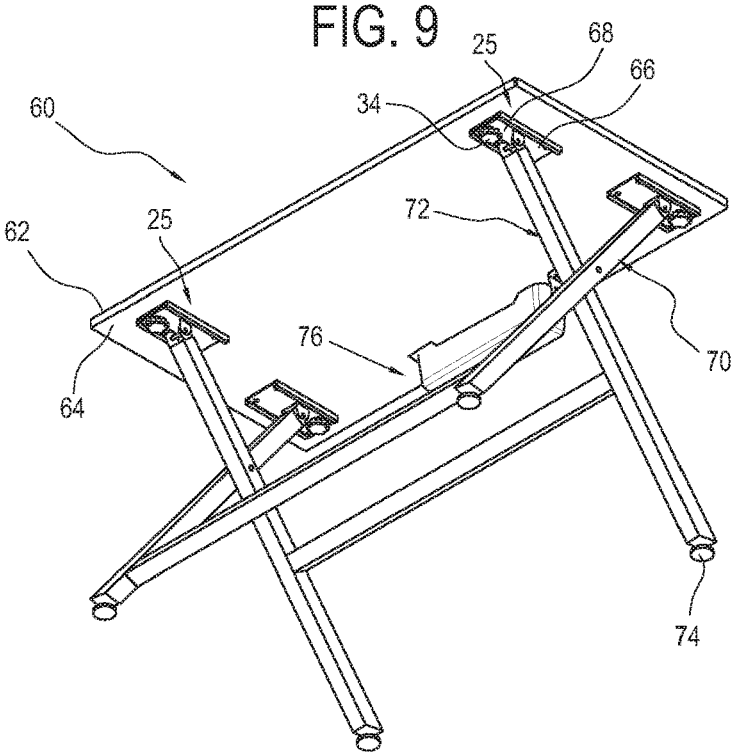
FIG. 10 is a perspective view of the adjustable height table of FIG. 9 from below, in a second position.
Figure 12:
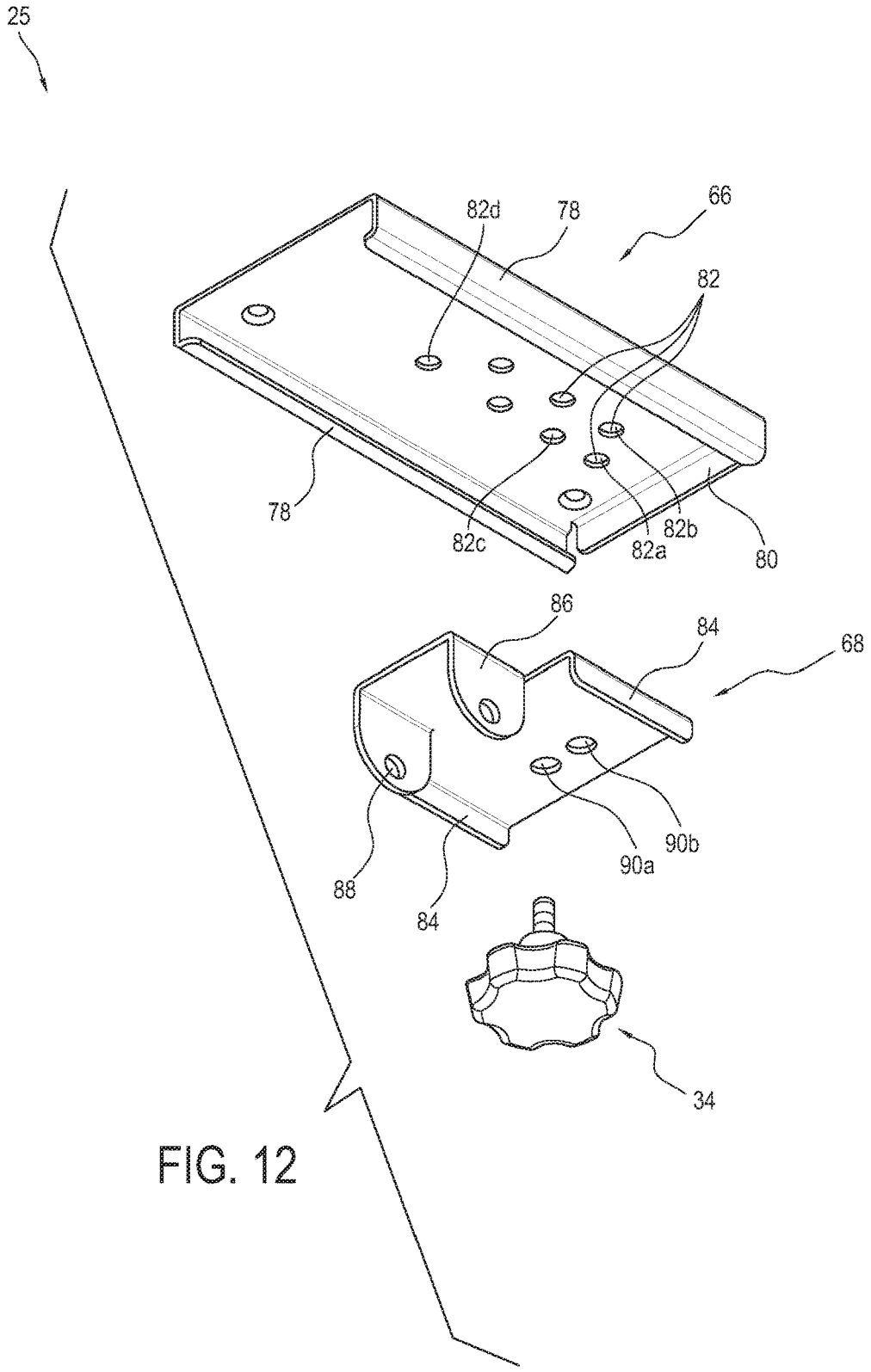
FIG. 12 is an exploded view of an embodiment of a multi-position leg mounting bracket of the adjustable height table according to FIG. 9.

Referring to FIGS. 9 and 10, an alternative table 60 is shown. The table 60 is substantially the same as the table 10 of FIGS. 1-8, with the addition of more positioning holes 82 (FIG. 12). The table 60 may be an elongate table, such as a rectangular table, although other shapes and sizes may be considered. The table 60 has a table top 62. The table top 62 has a lower surface 64 having guide tracks 66 attached thereon. Guide tracks 66 may be integral with the lower surface 64 of the table top 62, such as through molding, routing, casting, or machining. Alternatively, they may be attached in any known manner, such as welding, adhesion, molding, fastening, etc. The guide tracks 66 may have supports 78 (FIG. 12) which may accommodate a slide 68. The slide 68 may be attached to the guide track 66 with a hand knob 34, in a manner to be described herein. Alternatively, the slide 68 may be attached to the guide track 66 with a hand knob 34 in the manner described with respect to FIGS. 1-8. Although hand knobs 34 are described for retaining slides 68 in guide tracks 66, it is understood that other retainers may be used, such as, for example, pins, fasteners, screws, bolts, or other fastening members.

Referring to FIGS. 9 and 10, the table 60 may include a first pair of legs 70 and a second pair of legs 72. The first pair of legs 70 and the second pair of legs 72 may be connected to the table top 62. The first pair of legs 70 and second pair of legs 72 may be pivotally connected such that they may be moved between a first position (FIG. 9) and a second position (FIG. 10), for example, to adjust the height of the table top 62. The pairs of legs 70, 72 may have slides 68 which are laterally inserted into guide tracks 66 in the same manner as described with respect to FIGS. 1-8. Each guide track 66 may be provided with positioning holes 82 (FIG. 12) and each slide 68 may be provided with a locating hole 90. To adjust the table top 62 between various height positions, the slide 68 may be laterally moved within guide track 66 to align holes 90 and 82 at the desired height position. A retainer, such as hand knob 34, may be secured within holes 90 and 82 to secure the table top 62 at the desired height.

The pivotal connection may be a fastener. The fastener may be a bolt extending through a hole in the first pair of legs 70 and second pair of legs 72 secured with a nut on a side opposing the head of the bolt. Two fasteners may be provided, such that a first fastener extends through a first leg of each of the pairs of legs 70, 72 and the second fastener extends through a second leg of each of the pairs of legs 70, 72. Alternatively, the fastener may be any fastener, shaft, rivet, or pin which allows for relative movement between the first pair of legs 70 and the second pair of legs 72. The first pair of legs 70 and second pair of legs 72 may be connected such that in side view, the legs have the appearance of an "X" shape, however other embodiments are possible. The first pair of legs 70 and second pair of legs 72 may be constructed in a manner similar to first pair of legs 12 and second pair of legs 14 of FIGS. 1-8. The first pair of legs 70 and second pair of legs 72 may each include a first leg and a second leg attached with a lateral connecting member. The first pair of legs 70 and the second pair of legs 72 may be provided with feet 74. The feet 74 may allow for leveling the table top 62. Although two pairs of legs 70, 72 are described, more pairs of legs may be provided, for example, three, four, or more pairs. Additionally, it will be appreciate that embodiments of the present disclosure are not limited to pairs of legs 70, 72. For example, embodiments may include two legs that are each wide enough to provide sufficient stability. Alternatively, embodiments may include one wide leg surrounded by a pair of narrow legs on each side.

With continued reference to FIGS. 9 and 10, additional components may be attached to the table 60. For example, a container 76 may be attached to the lower surface 64 of the table top 62. The container 76 may store hand knobs 34, feet 74, fasteners, pins, or other components of the table 60 in storage or nonuse. Alternatively, the container 76 may store office supplies, or other objects when the table is in the open configuration. Although not depicted in FIGS. 9 and 10, brackets 36 (such as shown in FIG. 2) may attach to holes (not shown) in the lower surface 64 of the table top 62 with hand knobs 34 or other retainers. The brackets 36 may connect the table 60 to other equipment or other tables to construct a larger table of any size or configuration, as previously described in relation to FIG. 2.

Figure 11A:
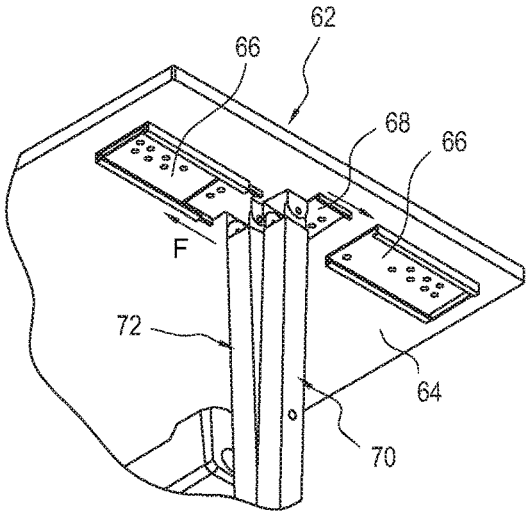
FIG. 11A is a detail view of the bottom surface of the adjustable height table according to FIG. 9 with the legs in a first position.
Figure 11B:
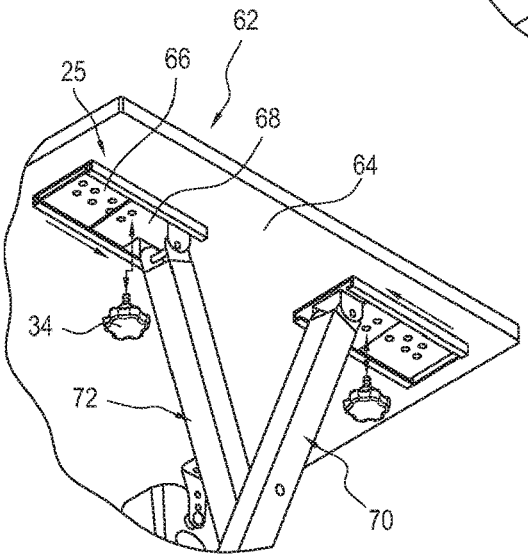
FIG. 11B is a detail view of the bottom surface of the adjustable height table according to FIG. 9 with the legs in a second position.
Figure 11C:
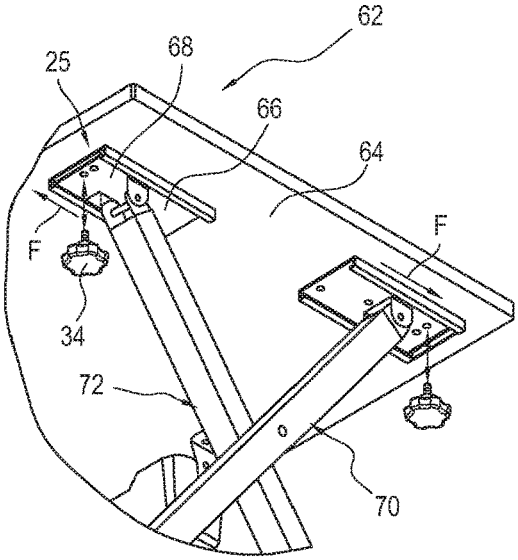
FIG. 11C is a detail view of the bottom surface of the adjustable height table according to FIG. 9 with the legs in a third position.

Referring to FIGS. 11A-11C, bottom views of the table top 62 are shown. As with the embodiment of FIGS. 1-8, the table 60 may include multi-position leg mounting brackets 25 that connect the legs 70, 72 to the lower surface 64 of the table top 62. Each of the multi-position leg mounting brackets 25 can include guide tracks 66 attached to, or formed in, the lower surface 64 of the table top 62, as previously described. The guide tracks 66 may be attached to the table top 62 by fasteners (not depicted). Alternatively, the guide tracks 66 may be secured to the lower surface 64 of the table top 62 in other manners, such as welding or adhesion. Alternatively, the guide tracks 66 may be formed integrally with the table top 62, such as by co-molding.

As shown in FIG. 12, each guide track 66 may be provided with positioning holes 82. Positioning holes 82 may receive retainers, such as hand knobs 34, for securing the legs 70, 72 to the lower surface 64 of the table top 62. As depicted in FIG. 12, a plurality of staggered positioning holes 82 may be provided in the guide track 66. Each positioning hole 82 may correspond to a predetermined table height. As will be described herein, this may allow the height of the table 60 to be selected and altered as desired. As depicted in FIG. 12, three positioning holes 82*a*, 82*b*, 82*c* may be provided in each guide track 26. Although only positioning holes 82*a*, 82*b*, 82*c* are identified, it will be appreciated from viewing FIG. 12, that more positioning holes may be provided. With reference to FIGS. 11 and 12, the slide 68 may include two or more locating holes 90*a*, 90*b*. The locating holes 90*a*, 90*b* in each slide 32 may align with one of the positioning holes 82 (FIG. 12). The inclusion of two locating holes 90*a*, 90*b* may allow for even more height positions to be selected. As will be described with reference to FIGS. 11A-11C, each slide 68 may be mated with a corresponding guide track 66. The locating hole 90*a* or 90*b* on the slide 68 may be aligned with one of positioning holes 82*a*, 82*b*, 82*c* where each positioning hole 82*a*, 82*b*, 82*c* corresponds to a desired height of the table. The slides 68 of the remaining three legs may be aligned with the same hole as the first slide 68 and secured into place with a retainer, such as hand knob 34. That is, where a first slide 68 of first leg of pair of legs 70 is aligned with positioning hole 82*a* and secured therein with hand knob 34, the remaining slides 68 of the other leg of pair of legs 70 and the legs of pair of legs 72 may be aligned with position hole 82*a* on their respective guide tracks 66 and secured therein with a hand knob 34.

Referring back to FIG. 11A, the first pair of legs 70 and second pair of legs 72 are each shown with the slide 68 being inserted into an opening of the respective guide track 66. Each of the legs of the pair of legs 70, 72 may be constructed similar to legs 12, 14 as described in relation to FIGS. 4A and 4B. For example, each pair of legs 70, 72 may comprise a pivoting connection between the legs and the slides 68. The pivoting connection may extend through holes 88 (FIG. 12) on a connecting member 86 (FIG. 12) of the slide 68 and into a hole on a top end of the pairs of legs 70, 72.

Referring now to FIGS. 11B and 11C, one of the locating holes 90*a* or 90*b* (FIG. 12) on the slide 68 may be aligned with one of the plurality of staggered positioning holes 82*a* (FIG. 12), where each positioning hole 82 corresponds to a height of the table. Once aligned, a retainer, such as hand knob 34, may be inserted into the aligned locating hole 90 and positioning hole 82. The hand knob 34 may be secured into place. Although hand knobs 34 are described for retaining slides 68 in guide tracks 66, it is understood that other fastening members may be used, such as, for example, pins, fasteners, screws, bolts, or other fastening members.

With continued reference to FIGS. 11B and 11C, the slides 68 of the remaining three legs may be aligned with the same hole as the first slide 68 and secured into place with a retainer, such as a hand knob 34. In FIG. 11B, the locating hole 90*a* or 90*b* is aligned with a position hole 82*a* located near to a centerline of the table 60, thus achieving a first table height position. In the position selected in FIG. 11C, the locating hole 90*a* or 90*b* is aligned with a positioning hole 82*d* located near to an edge of the table 60, thus achieving a second table height position. It may be appreciated that the first position of FIG. 11B may be higher than the second height of FIG. 11C. The first height may be higher than the second height since the pairs of legs 70, 72 are extended farther from the vertical in the position of FIG. 11C. It will be appreciated that the same positioning hole 82 and locating hole 90 will be selected on each leg of the pairs of legs 70, 72 to provide for a level table top 62. It will further be appreciated that the table of FIGS. 1-8 may be adjusted in height in a similar manner to the foregoing description.

With continued reference to FIGS. 11A-11C, during installation, the slide 68 may be inserted into an open end of the guide track 66. As the slide 68 is moved in the direction of the arrows "F" (FIGS. 11A, 11C), further into the guide track 66, the pair of legs 70, 72 are opened from the substantially vertical position of FIG. 11A to the more "X" shaped position of FIG. 11C. It may be appreciated that as the slides 68 of first leg of each of 70 and 72 are installed in guide tracks 66, the slides 68 of the second leg of each of 70 and 72 may be installed in their respective guide tracks 66 simultaneously or substantially simultaneously.

With reference to FIG. 12, an exploded view of an embodiment of a multi-position leg mounting bracket 25 according to the present invention is shown. As mentioned previously, the bracket 25 may include a guide track 66, slide 68, and a retainer to secure the slide 68 in a position on the guide track 66, such as a hand knob 34. The slide 68 may include a plurality of locating holes 90*a*, 90*b*. The locating holes 90*a*, 90*b* may align with one of the positioning holes 82*a, b, c, d* on the guide track 66. FIG. 12 shows the staggered positioning holes 82*a, b, c, d* allow for a plurality of table height positions to be provided on the table. The locating holes 90*a*, 90*b* are positioned adjacent one another such that at least one of the locating holes 90*a*, 90*b* will align with each of the staggered positioning holes 82*a, b, c, d*. Although seven positioning holes 82 (FIG. 12) and two locating holes 90 (FIG. 12) are depicted, it is understood that more or fewer positioning holes 82 and locating holes 90 may be provided.

Referring to FIG. 12, the guide track 66 may include projecting support 78 and stop 80. The projecting supports 78 may be channels having side and top surfaces that engage the respective flanges 84 on slide 68, although other supportive shapes are contemplated. During installation, the slide 68 may be laterally guided into an open end of the guide track 66. Flanges 84 of the slide 68 may engage the supports 78 on the guide track 66. In the installed position, a lower surface of the flanges 84 may engage top protruding surfaces of corresponding projecting support 78 to fix the slide 68 in the guide track 66 in the direction perpendicular to the plane of the guide track 66. The slide 68 can then be slid until the locating hole 90*a*, 90*b* aligns with the desired positioning hole 82*a*, 82*b*, 82*c*, 82*d* (e.g., corresponding to the desired table top height). The slide 68 can then be retained in position on the guide track 26, for example, by securing the hand knob 34 in the locating hole 90*a*, 90*b* and corresponding position hole 82*a*, 82*b*, 82*c*, 82*d*. As the slides 68 are provided into the channels created by projecting supports 78, the flange 84 of the slides 68 engages the projecting support 78 such that the slide 68 is retained in the guide track 66 in a vertical direction due to the mating geometries of the flange 84 and projecting support 78. Thus, prior to installation of the retainer (hand knob 34), the mating engagement of flange 84 and projecting support 78 may retain the slide in a vertical direction with respect to the legs, such that the table top 62 is supported by the pairs of legs 70, 72.

Alternatively, flanges may extend upward and downward from the slide. In this manner, the slide may be pivoted 180 degrees about the leg such that the previously upward facing flanges are now facing downward. The new downward facing flanges may be inserted into the channels of the guide tracks. The presence of upward and downward facing flanges may further increase the amount of height options allowed for the table.

FIG. 12 also shows a stop 80 provided on the guide track 66. The stop 80 may prevent the slide 68 from being extended too far into the guide track 66. The stop 80 may prevent the slide 68 from exiting the guide track 66. When a forward most end of the slide 68 engages a surface of the stop 80, the slide 68, and thus the pairs of legs 70, 72 to which the slide 68 is attached, is prevented from extending any further.

It may be appreciated from FIG. 12, that when slide 68 is installed in the guide track 66, engagement between the flange 84 and support 78 prevents collapse of the table 60. That is, even if a hand knob 34 has not yet been installed, or in the event a hand knob 34 is omitted, falls out, or is taken out by a user, the engagement of the flange 84 on the surface of the support 78 will prevent the slide 68, and thus the pairs of legs 70, 72 to which it is attached, from falling to the ground.

To collapse the table 60, after use or for storage, a user may first remove the hand knobs 34 from the positioning holes 82 and locating holes 90. The slides 68 may then be guided out of guide tracks 66. The pairs of legs 70, 72 may be collapsed from the "X" shaped position depicted to a substantially flat position where the first pair of legs 70 and second pair of legs 72 are substantially parallel.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A table, comprising:

a table top including an upper surface and a lower surface;

a first guide track and a second guide track located on the lower surface of the table top;

a first leg pivotally connected to a second leg, the first leg comprising a first slide adapted to slidably engage the first guide track, and the second leg comprising a second slide adapted to slidably engage the second guide track; and a first retainer adapted to engage the first slide and the first guide track to prevent sliding of the first slide with respect to the first guide track, and a second retainer adapted to engage the second slide and the second guide track to prevent sliding of the second slide with respect to the second guide track, wherein, when engaged, the first slide only engages the first guide track and the second slide only engages the second guide track, and wherein the first slide engages the first guide track independently of the second slide engaging the second guide track.

2. The table of claim 1, wherein the first slide is pivotally connected to a top of the first leg, and the second slide is pivotally connected to a top of the second leg.

3. The table of claim 1, wherein the first leg comprises a first pair of legs laterally connected together by a first lateral connecting member, and the second leg comprises a second pair of legs laterally connected together by a second connecting member.

4. The table of claim 1, wherein at least one of the first retainer or the second retainer comprises a hand knob having a threaded portion adapted to engage a threaded bore in at least one of the first guide track, the second guide track, and the lower surface of the table top.

5. The table of claim 1, wherein the first guide track includes two or more first positioning holes, and the first slide includes a first locating hole movable into registry with one of the first positioning holes.

6. The table of claim 5, wherein the first retainer is adapted to extend through the first locating hole and one of the first positioning holes.

7. The table of claim 1, wherein the second guide track includes two or more first positioning holes, and the second slide includes a first locating hole movable into registry with one of the first positioning holes.

8. The table of claim 7, wherein the second retainer is adapted to extend through the first locating hole and one of the first positioning holes, when the first locating hole and the one of the first positioning holes are in registry.

9. The table of claim 1, wherein the first leg defines a first midpoint and the second leg defines a second midpoint, and the first leg and the second leg are pivotally connected proximate the first midpoint and second midpoint.

10. The table of claim 1, the first slide further comprising a first flange, and the second slide further comprising a second flange, wherein the first flange engages a first channel on the first guide track and the second flange engages a second channel on the second guide track.

11. The table of claim 1, wherein the first guide track further comprises a first stop and the second guide track further comprises a second stop, wherein engagement between the first slide and the first stop and between the second slide and the second stop is configured to prevent the table from collapsing.

12. An adjustable height table, comprising:

a table top including an upper surface and a lower surface;

a first guide track located on the lower surface of the table top, the first guide track having a first positioning hole and a second positioning hole;

a second guide track located on the lower surface of the table top, the second guide track having a third positioning hole and a fourth positioning hole;

a first leg pivotally connected to a second leg, the first leg comprising a first slide adapted to slidably engage the first guide track, and the second leg comprising a second slide adapted to slidably engage the second guide track;

the first slide having a first slide locating hole and the second slide having a second slide locating hole; and a first retainer adapted to engage the first slide and the first guide track to prevent sliding of the first slide with respect to the first guide track, and a second retainer adapted to engage the second slide and the second guide track to prevent sliding of the second slide with respect to the second guide track, wherein, when engaged, the first slide locating hole is aligned with one of the first positioning hole and the second positioning hole and the second slide locating hole is aligned with one of the third positioning hole and the fourth positioning hole, wherein, when engaged, the first slide only engages the first guide track and the second slide only engages the second guide track, and wherein the first slide is pivotally connected to a top of the first leg with a first connecting member and the second slide is pivotally connected to a top of the second leg with a second connecting member.

13. The adjustable height table of claim 12, wherein when the first slide locating hole is aligned with the first positioning hole and the second slide locating hole is aligned with the third positioning hole, the table top is at a first height.

14. The adjustable height table of claim 13, wherein when the first slide locating hole is aligned with the second positioning hole and the second slide locating hole is aligned with the fourth positioning hole, the table top is at a second height.

15. The adjustable height table of claim 14, wherein the first height is taller than the second height.

16. The adjustable height table of claim 12, wherein the first retainer is secured into the aligned first slide locating hole and the one of the first positioning hole and the second positioning hole; and the second retainer is secured into the aligned second slide locating hole and the one of the third positioning hole and the fourth positioning hole.

17. The adjustable height table of claim 12, further defining an angle between the first leg and the second leg and wherein the first leg and the second leg are moveable between a first position and a second position, where the angle in the second position is larger than the angle in the first position.

18. A multi-position mounting bracket, comprising:

a guide track having a projecting support and a stop, the projecting support extending between an open end of the guide track and the stop;

a slide having a flange extending downward from the slide; and a retainer, the retainer adapted to engage the slide and the guide track to prevent sliding of the slide with respect to the guide track, and wherein a lower surface of the flange is configured to rest on a top surface of the projecting support, wherein the multi-position mounting bracket is configured to attach to a table.

19. The multi-position mounting bracket of claim 18, the projecting support further comprising a channel, and wherein the flange is configured to engage within the channel.

20. The multi-position mounting bracket of claim 18, wherein engagement between the slide and the stop is configured to prevent the table from collapsing.

21. The multi-position mounting bracket of claim 18, the slide further comprising one or more locating holes and the guide track comprising one or more positioning holes, wherein one of the one or more locating holes is configured to align with one of the one or more positioning holes.

22. The multi-position mounting bracket of claim 18, the retainer further comprising a hand knob configured to thread into one or more locating holes on the slide and one or more positioning holes on the guide track.

* * * * *